US005569491A

United States Patent [19]

Innes et al.

[11] Patent Number: 5,569,491

[45] Date of Patent: Oct. 29, 1996

[54] METHOD AND APPARATUS FOR COATING STRIP ARTICLE UP TO STRIP EDGE

[75] Inventors: Robert A. Innes, Kingston; Gary J. Smith, Glenburnie, both of Canada

[73] Assignee: Alcan International Limited, Montreal, Canada

[21] Appl. No.: 344,568

[22] Filed: Nov. 23, 1994

Related U.S. Application Data

[63] Continuation-in-part of Ser. No. 68,990, May 27, 1993.

[51] Int. Cl.[6] ..... B05D 3/12; B05D 5/00; B05C 3/02

[52] U.S. Cl. ..... 427/284; 427/355/369; 118/410; 118/413

[58] Field of Search ..... 427/284, 355, 427/356, 358, 369; 118/407, 410, 413, 419

[56] References Cited

U.S. PATENT DOCUMENTS

| | | | |
|---|---|---|---|
| 4,480,583 | 11/1984 | Tanaka et al. | 118/410 |
| 4,675,230 | 6/1987 | Innes | 427/280 |
| 4,867,097 | 9/1989 | Foltz | 118/407 |
| 5,083,524 | 1/1992 | Hiraki et al. | 118/407 |
| 5,206,056 | 4/1993 | Shibata et al. | 427/356 |

FOREIGN PATENT DOCUMENTS

| | | |
|---|---|---|
| 0067060 | 5/1986 | European Pat. Off. . |
| 0595295 | 4/1994 | European Pat. Off. . |
| 0639332 | 2/1994 | Japan . |

*Primary Examiner*—Shrive Beck
*Assistant Examiner*—Fred J. Parker
*Attorney, Agent, or Firm*—Cooper & Dunham LLP

[57] ABSTRACT

Apparatus for coating a strip article comprises a coating head having a coating surface and elongated open-sided slot formed in the coating surface communicating with an interior channel for delivery of coating material to said slot for transfer to a strip article to be coated. The slot has a slot extension extending into the coating surface at at least one longitudinal end of the slot for applying coating material to an edge region of the strip article. The slot extension communicates with the interior channel only through a constricted opening that prevents substantial leakage of coating material from the slot extension when the slot extension becomes uncovered by the edge region of the strip article. In this way, the strip article can be coated completely up to its transverse edges, without risk of substantial spillage of coating material if the ends of the coating slot become uncovered by the strip article due to inaccurate tracking or variable strip width.

8 Claims, 3 Drawing Sheets

METHOD AND APPARATUS FOR COATING STRIP ARTICLE UP TO STRIP EDGE

CROSS-REFERENCE TO RELATED APPLICATION

This application is a continuation-in-part of co-pending application Ser. No. 08/068,990, filed May 27, 1993.

BACKGROUND OF THE INVENTION

I. Field of the Invention

This invention relates to a method and apparatus used for the direct coating of strip articles, particularly metal sheet, with paints, plastics or other coating materials, provide surface protection and/or to improve the appearance of the article.

II. Description of the Prior Art

Metal sheet material, and particularly thin aluminum strip used for building siding, beverage can stock and other purposes, is frequently coated with materials such as paints or plastics to provide surface protection and/or decorative finishes. The coatings are typically applied by dissolving or suspending polymers and other components in organic solvents, applying the resulting mixtures by roller coater to the strip article, and baking the resulting product to remove the solvents and to cross-link the polymers.

An alternate means of coating sheet articles is to employ a coating die in the form of a coating head having an elongated open sided coating slot arranged transversely to the strip through which the coating material is extruded directly onto the strip surface as in is moved past the coating head. The thickness of the coating produced in this way can be controlled by using a spacer of some kind (e.g. a roller "doctor blade") that separates the coating head from the surface of the strip article and rides along the surface of the strip as the coating is applied. Such a spacer maintains the height of the coating gap (the gap between the coating head and the surface of the strip article) at a constant, preset value regardless of any lack of uniformity of the strip or strip feed mechanism.

Another way of maintaining a constant coating gap support the ends of the coating head that extend transversely beyond the edges of the strip article by means of a supporting structure attached to a frame carrying the strip article feed mechanism. The supporting structure maintains the desired coating gap, but nothing contacts the surface of the strip article, thus reducing the possibility of marking of or damage to the surface to be coated.

Yet another way of maintaining a desired coating gap is to use a coating head that "floats" on the layer of coating material as it is applied to the surface of the strip article. An apparatus of this kind suitable for single-sided coating of sheet material without reliance on mechanical spacers is disclosed in U.S. Pat. No. 4,675,230 of Jun. 23, 1987, assigned to the same assignee as the present application (the disclosure of this patent is incorporated herein by reference). Moreover, a related apparatus and method of two-sided coating of sheet material is disclosed in pending patent application Ser. No. 08/068,990, filed May 27, 1993 and assigned to the same assignee as the present application (the disclosure of which application is also incorporated herein by reference). The types of apparatus disclosed in this patent and patent application rely on the hydrodynamics of the coating material as it is applied to the metal strip for control of the film thickness and can readily compensate for variations in the gauge of the strip and eccentricity of the support roll. This is achieved by using a coating head having an extended surface on the downstream side of the coating slot forming an angle (normally in the range of 0.1° to 5°, or more preferably 0.5° to 1°) with the moving strip creating a coating gap converging in the direction of the strip advance. The extended surface directly contacts the coating material as it is applied to the strip generating hydrodynamic forces that cause the head to "float" on the layer of coating as it is applied to the strip. A load is applied to the coating head to counter balance the hydrodynamic forces to maintain a constant coating gap. Direct contact between the strip and the coating head is thus avoided, and this in turn avoids damage to or defacement the metal or pre-coated metal surface to which the coating is being applied.

While direct coating devices of the types mentioned above are effective for strip coating, they suffer from the disadvantage that inadvertent uncovering of the ends of the coating slot by errors in strip tracking or by variations in strip width can result in extensive leakage of the coating material from the slot, which normally requires stoppage of the coating line to correct the condition and to clean up the spilled coating material. To reduce the likelihood of this happening, it has been necessary to leave uncoated bands, often several millimeters wide, at the sides of the strip article to provide safety zones within which the positions of the side edges of the strip may vary without uncovering parts of the slot. For some articles, such as aluminum siding, this has been unimportant because the edges of the sheet are concealed in the final product. For other products, such as beverage can end stock, the edges are frequently trimmed after coating and there is anyway a 1 to 2 mm wide edge band left on the "skeleton" after the lids have been punched out. However, there are products that make use of the full width of the coated strip article, and even with can end stock it is desirable to coat the strip as close as possible to the strip edges for aesthetic if not for functional reasons.

There is therefore a need for a method and apparatus for coating strip articles in which the coating can be brought closer to the strip edges without increasing the risk of substantial spillage of coating materials.

SUMMARY OF THE INVENTION

An object of the invention is to improve the coating of strip articles when using coating apparatus that employs an elongated slot for applying a coating onto moving surfaces of such articles.

Another object of the invention is to enable coating apparatus of the stated kind to coat strip articles closer to the side edges of the strip without unduly increasing the likelihood of uncontrolled spillage of the coating material from the coating head.

Yet another object of the invention is to reduce accidental spillage of coating material from coating apparatus used for coating strip articles.

The present invention makes use of a coating head having slot extensions at one, or more preferably both, longitudinal ends of the slot used for applying coating material to the extreme lateral edges of the strip surface. The slot extensions extend beyond the ends of the coating slot and are generally aligned longitudinally with the slot (transversely with respect to the direction of movement of the strip article). They form slot extensions in the sense that, at the level of the coating surface of the coating head, the slot and slot extensions form channels running into each other, although a small barrier extending to the coating surface may be present in some embodiments if the barrier is so narrow in the longitudinal direction of the slot and slot extension that the applied coating is not adversely affected. The slot extensions differ from the slot itself in that coating material is supplied to the slot extensions through a restricted opening or passage that limits the spillage of coating material from the slot extensions if the coating material-containing parts of the slot extensions become completely uncovered by the strip article. To achieve this result, the coating material may be fed into the slot extensions solely longitudinally from the slot itself (even over the top of a narrow barrier as discussed above) or through a separate constricted passageway to positions at or near the ends of the slot extensions adjacent to the slot.

Most preferably, the slot is provided with slot extensions at both of its longitudinal ends, but a slot extension may be required only at one end for special coating applications.

Thus, according to one aspect of the invention, there is provided apparatus for coating a strip article, comprising: a coating head having a coating surface and an elongated open-sided slot formed in said coating surface communicating with an interior channel for delivery of coating material to said slot; a strip article feeder for continuously longitudinally advancing a strip article, having lateral edge regions, successively past the coating surface and the slot in a direction transverse to the slot; spacing equipment for spacing said coating surface of the coating head from a major surface of said strip article by a distance suitable for coating a layer of said coating material from said slot onto said major surface; and a supply apparatus for supplying liquid coating material under pressure to the interior channel; said slot having a slot extension extending into said coating surface at at least one longitudinal end of the slot for applying coating material to an adjacent edge region of the strip article, said slot extension communicating with said interior channel only through a constricted opening that prevents substantial leakage of coating material from said slot extension when said slot extension becomes uncovered during use by said edge region of said strip article.

According to another aspect of the invention, there is provided a method of extrusion coating a strip article with a liquid coating material, comprising: expressing a liquid coating material from an interior channel in an elongated coating head through an elongated slot onto a major surface of a strip article advancing past said clot; and contacting expressed coating material with a surface of said coating head to form a layer of coating material of desired thickness on said strip article; wherein said major surface has an edge region adjacent to a lateral edge of said strip article and wherein said edge region is coated substantially completely to said edge by advancing said edge region past a longitudinal extension of said slot fed with coating material from said interior channel only through a constricted opening that prevents substantial leakage of said coating material from said slot extension when said slot extension becomes uncovered by said edge region of said strip article.

The invention also relates to a coating head for use in the above apparatus and a kit of parts suitable for assembling a coating head for the apparatus.

The apparatus and method of the invention are most preferably carried out with liquid coating materials having viscosities greater than 30 centipoise since fluids having lower viscosities may flow readily sideways from the slot ends of a coating head, even without the slot extensions provided in the present invention. Examples of suitable coating materials that generally have the required viscosities include paints, lacquers, lubricants and adhesives.

The invention is applicable to coating heads of any of the above-mentioned kinds, but is particularly suitable for use with coating heads of the "floating" kinds that rely on the generation of hydrodynamic forces by the coating material, e.g. as disclosed in the patent and patent application mentioned above.

DETAILED DESCRIPTION OF THE PREFERRED EMBODIMENTS

Figure 1:
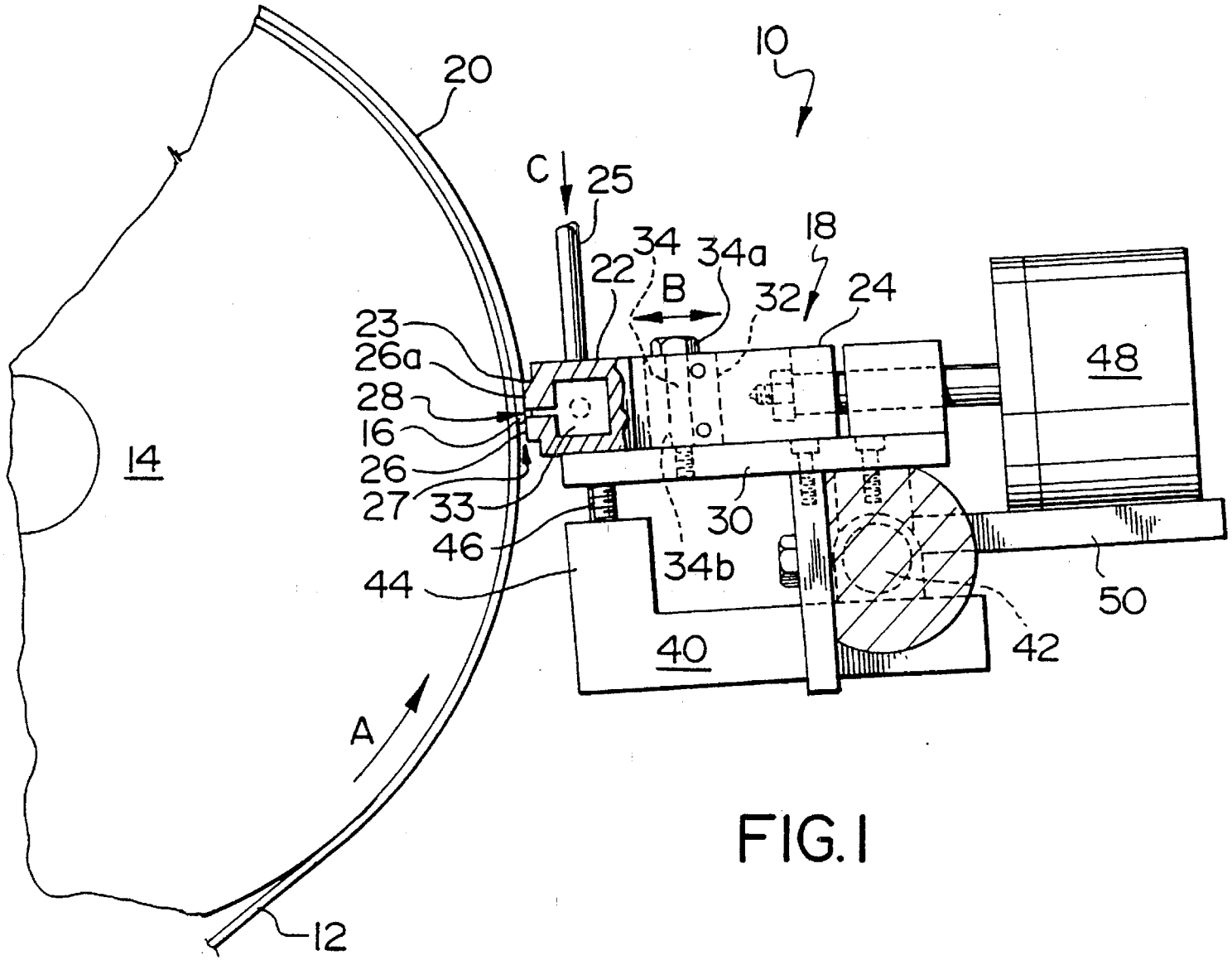
FIG. 1 is a side elevation, partly in cross-section, of equipment according to one preferred form of the invention used for the coating of strip articles.

FIG. 1 is a detailed side view of a strip article coating apparatus 10 intended for single-sided coating of the type described in U.S. Pat. No. 4,675,230 mentioned above, but modified according to the present invention. In this apparatus 10, a metal strip 12 to be coated is continuously advanced (by suitable and, for example, conventional strip advancing means such as rotated gripping rollers) in the direction of arrow A around a backup drum 14 that is rotatably supported in an axially fixed position. At a locality at which the strip 12 is held firmly against the backup drum 14, liquid coating material 16 (e.g. paint) is applied to the outwardly facing major surface of the strip from a coating device 18 to establish on the strip surface a continuous layer 20 of the coating material.

The coating device 18 includes a rigid coating head 22 attached to, or forming part of, a metal block 24 and having a flat or concavely curved coating face 26, including an extended surface **26*a* on the downstream side of the coating head from an elongated open-sided coating slot 28 and spaced from the surface of the strip article and arranged at an angle to define therewith a coating gap 27** which converges slightly in the direction of movement A of the strip.

The apparatus includes a deck 30 having a flat upper surface on which the metal block 24 rests, the block being thus supported for sliding movement relative to the deck in a generally horizontal direction perpendicular to the strip 12, as indicated by the doubled-headed arrow B. A number of vertically opening slots 32 (only one of which is shown in FIG. 1), elongated horizontally in the direction of arrow B, are formed in the body of the block 24 rearwardly of the coating head 22 at locations spaced along the length of the block. Bolts 34 (only one of which is shown) respectively extend through these slots and are threaded into the deck 30 at one end while having enlarged bolt heads 34*a* at the other end to retain the block 24 on the deck 30. Interference between the bolt shanks 34*b* and the side walls of the slots 32 prevents lateral movement of the block 24 relative to the deck, but the elongation of the slots permits the block 24 to move in the direction of arrow B through the full range of operative head positions.

The deck 30 is mounted on a support frame 40 for pivotal movement about a horizontal axis 42, so as to enable the block 24, with the deck 30, to be swung upwardly (e.g. by suitable pneumatic means, not shown) from the position illustrated in FIG. 1 to a position removed from the path of the advancing strip. An arm 44, fixedly secured to the frame 40 and underlying the deck 30, carries a screw 46 that projects upwardly from the arm and bears against the lower surface of the deck 30, to enable adjustment of the angular orientation of the head 22 in its operative position.

The frame 40 is fixed in position relative to the axis of the drum 14, both the frame and the drum being mounted in a common support structure (not shown). Thus, the axis 42 is also fixed in position relative to the axis of the drum 14.

The apparatus further includes means acting between the deck 30 and the coating head 22 for continuously exerting a load on the head to urge the head toward the facing surface of the strip 12. This load-exerting means comprises a pair of air cylinders 48 (only one of which is shown and which may be of generally conventional construction) fixed securely to the deck 30 rearwardly of the block 24. As shown, the cylinders 48 are in fact secured to a rearwardly projecting ledge portions 50 of the deck. Actuation of the cylinders 48 causes the block 24 to be pushed towards the surface of the strip 12. This load is opposed by the hydrodynamic force generated by the coating material 16 and exerted against the extended surface 26 as the coating material passes through the converging gap 27 between the surface of the strip 12 and the extended surface 26 of the coating head. As a result of this, the coating head "floats" on the coating layer 20 as it is formed and a motoring orifice is defined between the downstream edge 23 of the coating surface 26 and the surface of the strip, the size of the motoring orifice being determined (for a given coating) by the magnitude of the load exerted by the cylinders 48. Hence coatings of a desired thickness can be produced.

Figure 2:
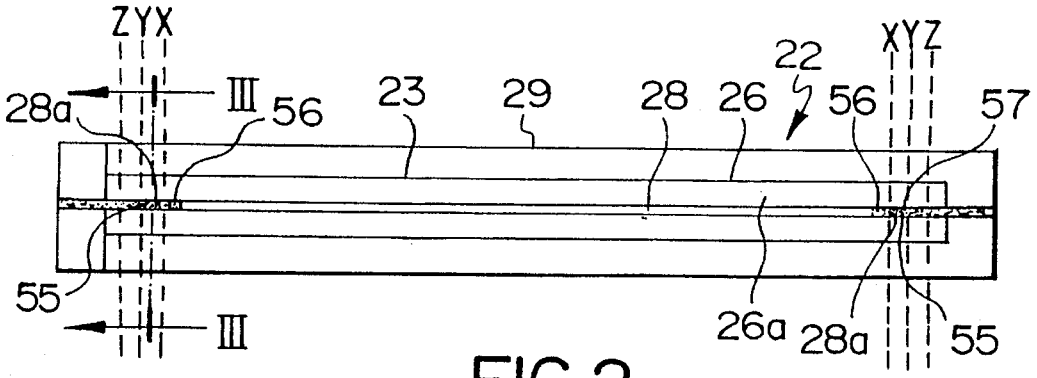
FIG. 2 is an elevational view of the coating face of a coating head that may be used in the equipment of FIG. 1, viewing said coating face as it would be seen from the position of drum 14 in FIG. 1 if such drum were removed.
Figure 3:
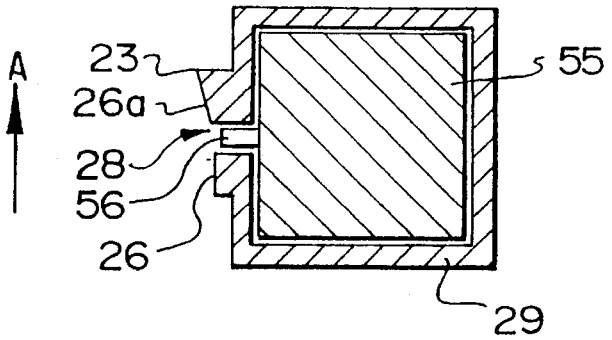
FIG. 3 is a transverse cross-section on an enlarged scale of the coating head of FIG. 2 taken on the line III—III.
Figure 4:
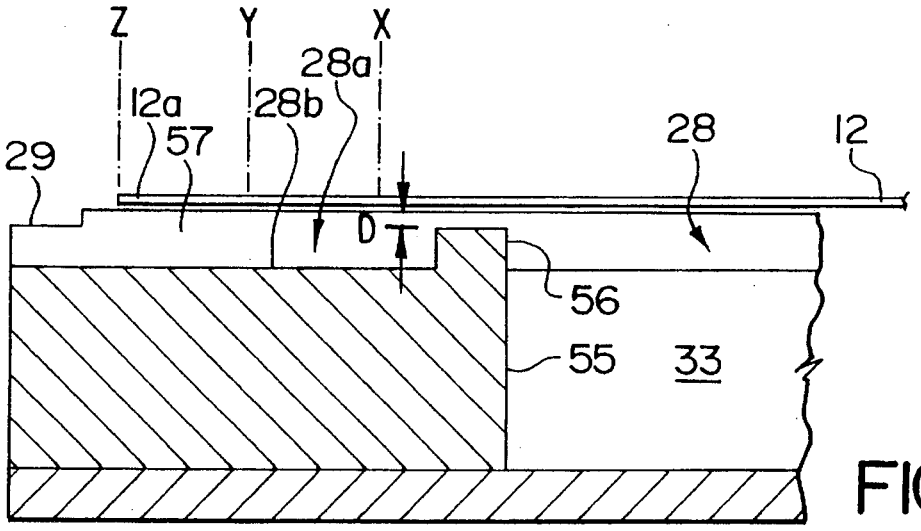
FIG. 4 is a partial longitudinal cross-section of the coating head of FIG. 2, rotated through 90° with the coating slot shown uppermost, showing one end of the coating head and part of the strip article in a position to be coated.

The coating head 23 employed in the present invention preferably takes the form of a hollow elongated rectangular body 29 or "coater bar" as shown more clearly in one form in FIGS. 2, 3 and 4, although it could alternatively be a mainly solid body provided with suitable internal passageways for the coating material. The body 29 incorporates the elongated opening extending from end to end, part of which opening forms the coating slot 28 previously mentioned extending from the coating face 26 of the body inwardly to an enclosed hollow interior channel 33. Although not shown in FIGS. 2, 3 and 4, means are provided for introducing a fluid coating material under pressure into the hollow interior channel 33 of the body 29, this means being represented by tube 25 and arrow C in FIG. 1. A conventional liquid paint supply reservoir and pressure pump feed apparatus may be used for this purpose.

The coating material is expressed from the interior channel 33 within the body 29 through the slot 28 to contact the adjacent surface of the strip 12 and whereupon it is metered by the extended surface 26*a* and the downstream edge 23 of the coating surface 26.

As described so far, the coating head 22 is largely conventional, but the hollow body 29 is also provided with a pair of internal end plugs 55 that extend into the body 29 by certain limited distances and these plugs delimit the longitudinal extent of the interior channel 33 available for receiving coating material. It should be noted, however, that the slot opening in the wall of the body extends longitudinally past the plugs 55 and that each plug has a short upstanding projection forming a fin 56 extending from the body of the plug into the slot opening by a distance that places the outermost end of the fin a small distance short of the coating surface 26 of the body 29, this distance being indicated as gap D in FIG. 4. The parts of the opening extending past the plugs and fins form slot extensions 28*a*. In the illustrated embodiment, the fins 56 are present only immediately adjacent to the longitudinally innermost ends of the plugs 55, so that the slot extension is unoccupied to its full depth (the thickness of the wall of the hollow body 29) in a region 57 between the fins 56 and the extreme ends of the body 29. Hence the slot extensions have a shallower part above the fins 56 and a deeper part in the region 57 above the remainder of the plugs 55. The fine 56 could, however, extend along the full length of each plug 55, thus forming a slot extension of constant depth throughout.

Because of the presence of the plugs 55, the slot extensions 28*a* do not communicate directly with the hollow interior channel 33 and, unlike the coating slot 28 itself, are thus not supplied with coating material from below (i.e. directly from within the body 29). The slot extensions 28*a* are, however, fed with coating material transversely from the slot 28 through the gap D. Since the coating material in the channel 33 and the slot 28 is under pressure, sufficient coating material enters the slot extensions 28*a* in this way to provide a flow of coating material that is transferred to the edge regions 12*a* of the strip.

In this embodiment, the plugs 55 are not removable (although they could be, if desired), but strips of different widths (as indicated by dotted lines X—X, Y—Y and Z—Z) may be coated by the apparatus by suitably controlling the pressure of coating material in the channel 33 (higher pressures force more coating material into the slot extensions 28*a* so that wider strips can be coated right up to their lateral edges). In a particularly preferred embodiment, the plugs 55 are each about 1 inch in length and the fins 56 occupy about 0.1 inch of that length (i.e. the fins extend about 0.1 inch laterally along the slot 28 from the innermost end of the plugs 55). The depth of the slot extensions 28*a* is about 0.15 inches in those regions clear of the fins 56 and the gap D is about 0.005 to 0.050 inches. The optimal size of gap D will vary from case to case according to various parameters such as the width of the slot 28 and the viscosity and pressure of the coating material, and can easily be determined by simple trial and experimentation.

In operation, as shown most clearly in FIG. 4 (in which the edge of the strip 12 is shown in position Z, but could be in alternative positions such as those shown by broken lines Y and X, as explained above), the strip 12 to be coated extends laterally beyond the ends of the slot 28 itself, but preferably not beyond the ends of the slot extensions 28*a*. Although the slot extensions 28*a* have extreme ends that are uncovered during normal use, no leakage of coating material takes place from these uncovered regions because the limited amount of coating material entering the slot extensions through the gap D is completely transferred to the edge regions 12*a* of the strip article before the material can progress to the uncovered regions of the slot extensions. In use, therefore, the amount of fluid outflow from the slot extension 28*a* is ideally balanced by the amount of fluid inflow through the gap D. If there is too much outflow relative to inflow, the strip might not be coated completely to the edge. On the other hand, if there is too much inflow relative to outflow, the layer of coating material applied to the edge regions may be too thick, resulting in overflow of coating to the support roll (in single sided coating) or the formation of a thick bead at the strip edge (in two-sided coating). The ratio of inflow to outflow can be controlled by such means as the pressure of the coating material, the speed of advancement of the strip article, etc.

If the slot extensions 28*a* become fully uncovered during strip coating, e.g. because of poor tracking control of the strip or because of variations in the width of the strip, but the slot 28 itself remains fully covered, little or no coating material spills out of the coating head through slot extensions 28*a* because (a) very little coating material is present in the slot extensions at any given time, and (b) the constricted opening (gap D) at the entrance to the slot extension 28*a* from the slot 28 (defined by the fin 56, the sides of the opening in the body 29 and the adjacent surface of the strip article) limits the amount of coating material (if any) that may spill from the slot extension 28*a*, provided this opening itself is not uncovered, thus allowing material to spill directly from slot 28 itself. The use of the slot extensions therefore make it possible to coat strip articles right up to the lateral edges without causing problems of coating material leakage if the slot extensions become temporarily uncovered (or uncovered closer to the slot 28 than is normal) during use.

Figure 5:
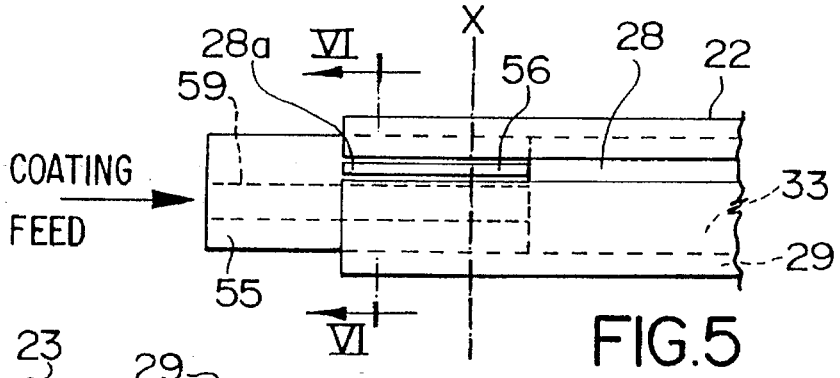
FIG. 5 is a partial view similar to that of FIG. 2 of an alternative coating head according to another preferred form of the present invention.
Figure 6:
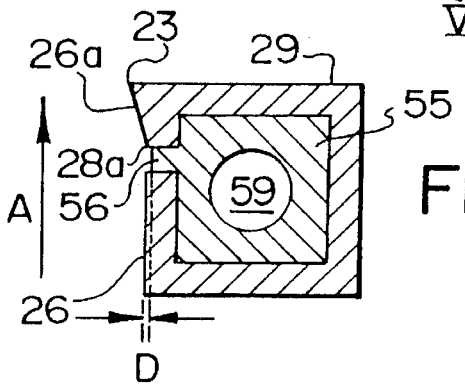
FIG. 6 is a transverse cross-section of the coating head of FIG. 5 taken on the line VI—VI.

While as little as possible of the strip should extend beyond the slot 28 itself, because the slot itself provides proper coating to the desired thickness, sufficient amounts of the strip should extend over the slot extensions 28*a* to ensure that the slot 28 itself never becomes uncovered during the coating operation. This amount is consequently determined by the tracking accuracy of the feed and coating apparatus and the variation in the width of the strip over its full length FIGS. 5, 6, 7 and 8 show an alternative embodiment of a coating head 22. In this case, the coating head again consists of a hollow rectangular elongated body 29, but the extreme lateral ends of the body are open and slidably partially receive width adjustment plugs 55 (only one of which is shown in FIGS. 5 and 6). These plugs are much the same as the ones used in the embodiment of FIGS. 2–4 in that they have fins 56 and define the longitudinal ends of the coating chamber 33, but they differ in that they project from the open ends of the body 29 and are movable so that the effective width of the slot 28 that is fed with coating material directly from within the hollow interior channel 33 can be varied by slidably moving one or both of the plugs 55. In this way, strips of different widths can easily be accommodated by the apparatus. Additionally, the left hand plug 55 shown in the drawings has an interior axial passage 59 through which the coating material can be introduced into the hollow interior channel 33 of the body 29, e.g. from supply tube 25 (see FIG. 1). The plug at the opposite end of the body may have no such axial passage so that coating material introduced into the hollow interior channel would be forced to exit through the slot 28, or it may alternatively be provided with an equivalent passageway and the coating material fed in through both plugs simultaneously with equal pressure such that backflow through either passageway is prevented. Simultaneous feed of coating material in this way provides a mere even delivery of coating material over the length of the slot 28.

The plugs 55 in this embodiment have fins 56 which extend fully along the slot extensions 28*a* so that the slot extensions 28*a* are of uniform depth along their entire length between the slot 28 and the ends of the body 29 and the gap D is the same as the slot depth (see FIG. 6). One suitable position for the edge of the strip is indicated by dotted line X in FIG. 5, but of course in this embodiment, the plugs 55 can be readily adjusted to the width of the strip.

In use, the lateral extensions 28*a* of the slot 28 that are blocked from within by the plugs 55 and fins 56 form shallow blind channels that receive some sideways flow of the coating material from the ends of the slot 28 through the gaps D. Unlike the previous embodiment, there are no fins 56, but the narrow entrances to the slot extensions 28*a* from the slot 28 proper acts as constrictions and define gaps D. As in the previous embodiment, the amount of sideways flow of the coating material into the slot extensions 28*a* that is required to cover the band or region of the strip article adjacent %o its lateral edges that is normally left uncoated in the conventional procedure is relatively small. The width of the slot 28 and the gap D define an constricted orifice that control the amount of sideways flow and this amount may be less than that required to maintain the film thickness repaired in other areas of the strip article, but the strip article will nevertheless be coated to some thickness in the edge regions. If this is the case, the extended surface 26 and edge 23 may not be fully or evenly contacted by the coating material in the edge regions of the strip article adjacent to the slot extensions 28*a* and will thus operate in a "starved condition" in these regions, but this is not harmful provided a minimum coating of the edge regions is achieved to provide acceptable edge coverage.

As previously noted, for a given gap D and slot width, the quantity of sideways flow, and the width of the strip article coated, can be controlled to some extent by varying the pressure applied to the coating material within the interior channel 33 of the body 29. This pressure has little effect on the coating thickness applied to the main section of the strip article, but it drives more or less coating material through the gap D. Although the coating head in this embodiment can accommodate different strip widths by relocation of the plugs 55, variations in pressure of the coating liquid can nevertheless be used as a means for fine adjustment of the coating width.

Figure 7:
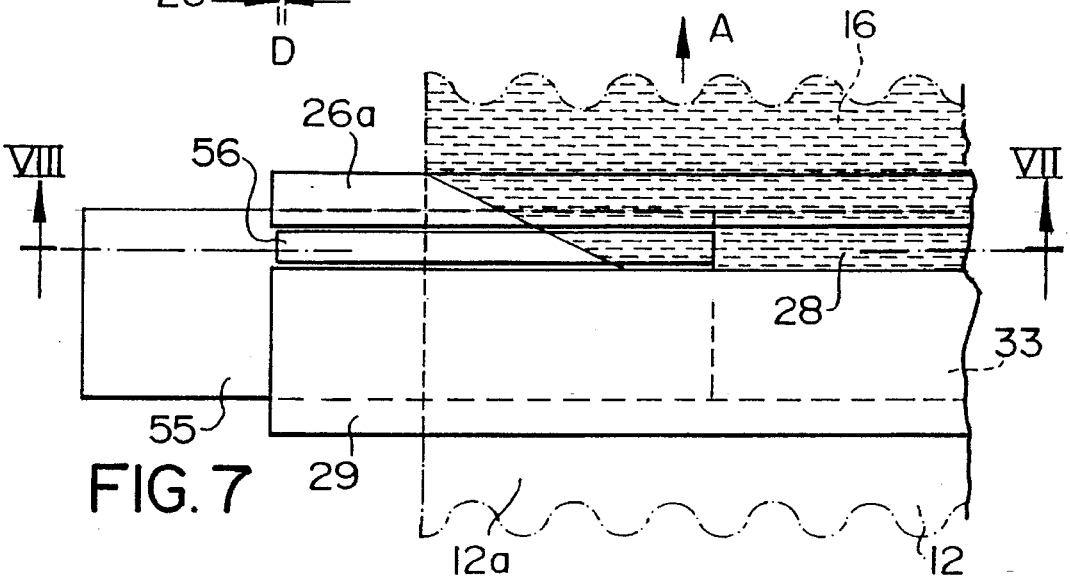
FIG. 7 is a slightly enlarged elevational view of the coating face of the coating head of FIG. 5 showing the pattern of coating material applied to the surface of a strip article as it passes the slot and slot extension at an edge region of the strip article.
Figure 8:
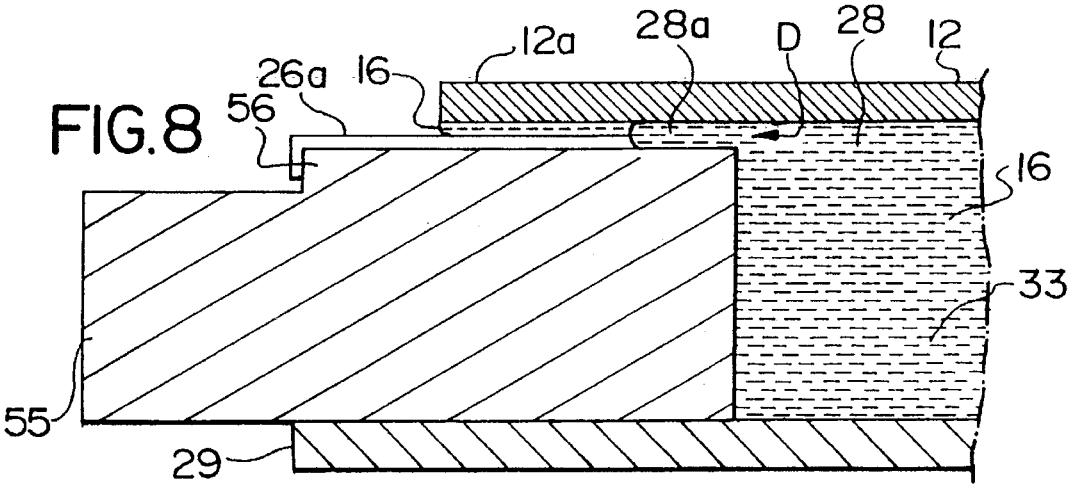
FIG. 8 is a cross-sectional view of part of the coating head and strip article taken on the line VIII—VIII of FIG. 7, after rotation of said Figure through 90° to orientate the coating slot uppermost, again showing the coating material being applied to the strip article.

As shown in FIGS. 7 and 8, the coating material 16 extends into and along the gap D from the slot 28 and contacts the overlying surface of the strip article 12 in its edge regions 12*a*. However, the coating material entering the slot extension 28*a* becomes withdrawn from the slot extension before it reaches the extreme outer edge of the strip 12, but the coated area continues to expand after the coated surface passes the slot extension 28*a* by virtue of the spreading action of the extended surface 26*a* of the coating face 26, so that the strip is completely coated right up to its edge immediately after passing the coating head. By properly adjusting the size of the gap D and the pressure of a given coating material, the coated area can be made to correspond to the full width, or close to the full width, of the surface area of the strip article after this continued expansion has stopped. The angle at which the coating head is orientated to the strip article may open up a clearance between the end of the slot and the strip article so that there may be some sideways flow from the end of the slot in any case. When using very low viscosity coating material of about 30 centipoise or less, this flow can be large enough to cause problems which the extensions to the slot of the present invention may exacerbate. Accordingly, higher viscosity coating material (e.g. 500 to 3000 centipoise) is preferably used in the present invention.

As an alternative to the use of end plugs 55, especially for apparatus intended for use with strips of constant width, the body 29 may be provided with permanent end walls and the slot extensions 28*a* may be formed as depressions in the coating face of the coating head, but unlike the slot 28 itself, may not extend completely through the wall of the coating head to communicate with the interior channel 33.

While the constricted opening (gap D) is most conveniently formed at the junction of the slot and the slot extension, the slot and slot extensions may if desired be completely separated by a barrier similar to fin 56 but extending completely to the coating face of the coating head. If this barrier is made very short in the longitudinal direction of the slot and slot extension, sufficient coating material may flow over the barrier from the slot to the slot extension through the coating gap between the coating head and the surface of the strip. The constricted opening is in these cases defined by the outermost edge of the barrier and the adjacent surface of the strip article. Alternatively, in such an embodiment, coating material may be fed to the slot extensions from the interior channel 33 through narrow (constricted) passages leading directly from the channel to the longitudinally inner ends of the slot extensions. The important consideration in all cases is that the slot extensions should be fed with sufficient coating material for coating up to the edges of the strip, but through openings that restrict the loss of coating material from the slot extensions when the slot extensions become uncovered by the strip article.

While the invention has been described as applied to single-sided coating equipment, it may also be applied to double-sided extrusion coating equipment, e.g. of the type disclosed in pending U.S. patent application Ser. No. 08/068,990. In such apparatus, two coating heads are provided directly in opposition on opposite sides of an advancing strip article so that each of the coating heads supports the strip during coating by the other. One or both of such coating heads may be provided with the slot extensions as described above so that the strip article may be coated up to, or very close to, the extreme side edges of the strip on one or both sides.

The coating head of the invention may be produced and sold as a kit of parts including the hollow housing 29 and at least two end plugs 55. Preferably, more than two plugs are provided of different lengths or the plugs may be dimensioned for a tight sliding fit for adjustment of the effective length of the coating slot 28 and sloe extensions 28*a*.

The invention is illustrated further by the following Example, which should not be considered limitative of the present invention.

EXAMPLE

A first series of tests employing a form of the present invention were carried out on a 12 inch wide coating pilot line. A second series of tests was also carried out using a variation of the invention where the constriction was limited to a region close to the end of the coating slot, and expanded beyond that, using equipment as shown in FIGS. 2 to 4. The results are shown in Table 1 below:

TABLE 1

Variable Width Coating Test Results From First Series of Tests

| Orifice Clearance | Coater Plate Load | Coated Width Beyond Slot End (inches) Slot Pressure (psi) | | | |
|---|---|---|---|---|---|
| (inches) | (psi) | 20 | 30 | 50 | 70 |
| 0.005 | 25 | 0.188 | 0.219 | 0.313 | 0.344 |
| 0.01 | 25 | 0.063 | 0.063 | 0.094 | 0.125 |
| 0.02 | 50 | 0.531 | 1.031 | 1.094 | 1.094 |
| 0.03 | 50 | 0.563 | 1.031 | 1.094 | 1.094 |

During these tests, the strip was advanced at 300 feet/minute and the coating material was a high solids solution of vinyl can end lacquer having a viscosity of 3000 centipoise.

What is claimed is:

1. Apparatus for coating a strip article, comprising:

a coating head having a coating surface and an elongated open-sided slot formed in said coating surface communicating with an interior channel for delivery of coating material to said slot;

a strip article feeder for continuously longitudinally advancing a strip article, having lateral edge regions, successively part the coating surface and the slot in a direction transverse to the slot;

spacing equipment for spacing said coating surface of the coating head from a surface of said strip article by a distance suitable for coating a layer of said coating material from said slot onto said surface; and a supply apparatus for supplying liquid coating material under pressure to the interior channel;

said slot having a slot extension extending into said coating surface at at least one longitudinal end of the slot for applying coating material to an adjacent edge region of the strip article, said slot extension having substantially a constant depth inwardly of the coating head from said coating surface, said depth permitting coating material in said cost to coat said edge regions of said strip article, said slot extension communicating with said interior channel only through a constricted opening that restricts leakage of coating material from said slot extension.

2. Apparatus according to claim 1 wherein said slot has said slot extensions at both longitudinal ends thereof.

3. Apparatus according to claim 1 wherein said slot and slot extension are linearly aligned and communicate with each other adjacent to said coating surface of the coating head, said constricted opening being positioned at a junction of said slot and said slot extension.

4. Apparatus according to claim 1 wherein said coating head comprises an elongated hollow body having first and second open longitudinal ends each receiving an end plug extending axially into a hollow interior of said body, said body having an elongated longitudinal opening in a wall thereof extending substantially from said first end to said second end, said slot comprising a part of said elongated longitudinal opening positioned between said end plugs and communicating with said hollow interior forming said interior channel for delivery of said coating material to said slot, said slot extensions being parts of said opening extending along said end plugs.

5. Apparatus according to claim 1 wherein said spacing equipment comprises a support for said coating head permitting movement of said coating head towards and away from said surface of said strip article, a load applying device for pushing said coating head towards said surface, and apart of said coating surface forming an extended surface on a downstream side of said slot relative direction of movement of said strip article past said coating head, said extended surface facing said surface of said strip article at an angle thereto to form a gap tapering in said direction of movement.

6. A method of extrusion coating a strip article with a liquid coating material, comprising:

extruding a liquid coating material having a viscosity greater than 30 centipoise from an interior channel in an elongated coating head through an elongated slot onto a surface of a strip article advancing past said slot; and contacting extruded coating material with a surface of said coating head to form a layer of coating material of desired thickness on said strip article;

wherein said surface has an edge region adjacent to a lateral edge of said strip article and wherein said edge region is coated substantially completely to said edge by advancing said edge region past a longitudinal extension of said slot fed with coating material from said interior channel only through a constricted opening that restricts leakage of said coating material from said slot extension, said slot extension having substantially a constant depth inwardly of the coating head from said coating surface over a full longitudinal extent of the slot extension, said depth permitting coating material in said slot to coat said edge regions of said strip article.

7. A method according to claim 6 wherein said strip article has an edge region adjacent to each side of said strip and each edge region is coated from a separate slot extension.

8. A method according to claim 6 comprising expressing from said slot a coating material having a viscosity of 500 to 3000 centipoise.

* * * * *